United States Patent [19]

Vogel

[11] Patent Number: 4,697,642

[45] Date of Patent: Oct. 6, 1987

[54] GRAVITY STABILIZED THERMAL MISCIBLE DISPLACEMENT PROCESS

[75] Inventor: John V. Vogel, Seabrook, Tex.

[73] Assignee: Tenneco Oil Company, Houston, Tex.

[21] Appl. No.: 879,577

[22] Filed: Jun. 27, 1986

[51] Int. Cl.[4] ..... E21B 43/24; E21B 43/40

[52] U.S. Cl. ..... 166/263; 166/266; 166/272

[58] Field of Search ..... 166/263, 266, 267, 272

[56] References Cited

U.S. PATENT DOCUMENTS

| | | | |
|---|---|---|---|
| 2,862,558 | 12/1958 | Dixon | 166/272 |
| 3,333,632 | 8/1967 | Kyte | 166/272 |
| 3,572,436 | 3/1971 | Riehl | 166/272 X |
| 3,608,638 | 9/1971 | Terwilliger | 166/272 |
| 3,768,559 | 10/1973 | Allen et al. | 166/272 |
| 3,838,738 | 10/1974 | Redford et al. | 166/271 |
| 3,946,810 | 3/1976 | Barry | 166/272 |
| 3,994,341 | 11/1976 | Anderson et al. | 166/272 |
| 4,008,764 | 2/1977 | Allen | 166/272 X |
| 4,008,765 | 2/1977 | Anderson et al. | 166/272 |
| 4,124,071 | 11/1978 | Allen et al. | 166/263 |
| 4,127,170 | 11/1978 | Redford | 166/272 X |
| 4,175,618 | 11/1979 | Wu et al. | 166/252 |
| 4,207,945 | 6/1980 | Hall et al. | 166/272 |
| 4,344,485 | 8/1982 | Butler | 166/271 |
| 4,398,602 | 8/1983 | Anderson | 166/245 |
| 4,431,056 | 2/1984 | Shu | 166/263 |
| 4,444,261 | 4/1984 | Islip | 166/272 |
| 4,458,759 | 7/1984 | Isaacs et al. | 166/272 |
| 4,495,994 | 1/1985 | Brown et al. | 166/263 X |

FOREIGN PATENT DOCUMENTS

| | | |
|---|---|---|
| 836325 | 3/1970 | Canada . |
| 852003 | 9/1970 | Canada . |
| 956885 | 10/1974 | Canada . |
| 977675 | 11/1975 | Canada . |
| 1001067 | 12/1976 | Canada . |
| 1002872 | 1/1977 | Canada . |
| 1010361 | 5/1977 | Canada . |
| 1016451 | 8/1977 | Canada . |
| 1061713 | 9/1979 | Canada . |
| 1067398 | 12/1979 | Canada . |
| 1088414 | 1/1980 | Canada . |
| 1082591 | 7/1980 | Canada . |
| 1130201 | 8/1982 | Canada . |
| 1151529 | 8/1983 | Canada . |
| 1208122 | 7/1986 | Canada . |

*Primary Examiner*—George A. Suchfield

*Attorney, Agent, or Firm*—Gunn, Lee & Jackson

[57] ABSTRACT

In a gravity stabilized thermal miscible displacement process for recovery of normally immobile high viscosity hydrocarbons in a subterranean formation, a steam and solvent vapor mixture is injected into the top of the formation, thereby establishing a vapor zone across the top of the formation. The steam and vapor mixture is lean or undersaturated in solvent vapors. The steam vapors condense to give up heat and raise the temperature of the underlying viscous hydrocarbons, thus reducing the viscosity thereof. The solvent vapors condense and go into solution with the viscous hydrocarbons, further reducing the viscosity thereof enabling the hydrocarbons to drain under the force of gravity into an adjacent production well completed at the bottom of the reservoir and where the hydrocarbons are recovered. The pressure at the producing well is controlled so that the pressure differential through the formation is approximately equal to the gravity head of the liquids in the formation.

24 Claims, 3 Drawing Figures

37
57
56
58
60
55
45
61
62
49
39
41
43
53
54
59
16
38
51
18
26
30
12
40
22
28
32
36
24
20
10
35
34
33
14

58
37
57
56
60
55
45
61
62
49
39
41
43
53
54
59
16
38
51
18
26
30
12
40
22
28
24
20
32
42
10
36
33
34
14

16
28
24
26
20
49
62
60
61
48
58
45
59
54
53
51
56
43
55
57
38
41
39
44
46
47
10
14
12
50
34
36
32
33
37

GRAVITY STABILIZED THERMAL MISCIBLE DISPLACEMENT PROCESS

BACKGROUND OF THE DISCLOSURE

This invention is directed to a method for recovery of highly viscous underground hydrocarbons, particularly, a gravity stabilized thermal miscible displacement process whereby viscous hydrocarbons are mobilized by reducing the viscosity of the hydrocarbons by the application of steam and a steam-solvent mixture.

Highly viscous hydrocarbons are known to exist in subterranean formations such as the Athabasca Tar Sands in Alberta, Canada. The viscosity of these large deposits of heavy hydrocarbons, however, is so high that even after heating, conventional steam recovery methods have not proved commercially viable. Steam flooding is a well known and accepted process in the industry for recovery of viscous hydrocarbons from a formation. Generally, steam is injected into the underground formation to heat viscous hydrocarbons to reduce their viscosity sufficiently to permit the hydrocarbons to flow through the formation and into a producing well. The mobilized hydrocarbons are then pumped or flowed to the surface. Generally, the steam is injected through one well at high temperature and pressure, thereby transferring sufficient heat to the viscous hydrocarbons to lower the viscosity sufficiently to permit the hydrocarbons to flow to the producing wells. Steam flooding has been commercially successful in many of the California heavy oil deposits, but not in the more viscous reservoirs such as the Athabasca Tar Sands.

In-situ combustion has also been attempted as a method of producing highly viscous hydrocarbons with moderate success in a few applications. Like steam, however, it has not been commercially successful in very viscous deposits such as Athabasca. Recovery methods have also been proposed which call for the use of solvents, diluents, or additives, either by themselves or along with steam to further reduce the viscosity and improve fluid transmissibility within a formation.

Hydrocarbon solvents are among the additives which have frequently been proposed in the prior art for use in recovery methods for viscous hydrocarbons. The use of hydrocarbons such as aromatic solvents is within the skill of the prior art. For example, toluene and benzene are commonly used for dissolving the heavier hydrocarbon components in viscous oil, and solvents such as these can readily be vaporized for injection with steam into an underground reservoir. Upon condensing they will dissolve and dilute the viscous hydrocarbons to reduce their viscosity and improve their mobility to a greater degree than can be achieved with heat alone.

None of these prior art solvent methods, however, have been successful on a commercial basis. Some of them require injection of excessive amounts of steam and/or solvent. In others, viscous fingers of solvent, gas, steam, or other diluents, break through to the producing wells which results in the circulation of excessive amounts of the solvent, or other drive additives, thus bypassing the viscous hydrocarbons and leaving a large percentage unrecovered. These recovery methods are usually referred to as "drive" methods because an attempt is made to establish a pressure differential across the reservoir to pressure drive the viscous hydrocarbons through the formation and into the producing wells.

One of the prior art methods which attempts to avoid these problems is exemplified by the patent to Terwilliger, U.S. Pat. No. 3,608,638, which discloses a process for producing low gravity, high viscosity oils from tar sands in which pure hydrocarbon solvent vapors, such as benzene, platformate, or kerosene, are injected into the top of the tar sands at an injection well and forced through the formation to an adjacent producing well. The temperature of the injected hydrocarbons is maintained high enough to maintain a gaseous phase to establish a permeable vapor-filled channel across the top of the formation. Oil flowing into the production well is lifted through the production well at a rate to maintain a low pressure, for example, less than 100 psi, adjacent to the production well. As production continues, the upper portion of the Tar Sands is left filled with hydrocarbon vapors, or liquid of low viscosity formed by the condensation of hydrocarbon vapors, which is to be recovered by a subsequent production step.

In any oil recovery process, high production rates of heavy hydrocarbons are desirable. It is well known, however, that the flow rates of fluids through an underground reservoir or formation are proportional to the viscosity of the fluids. Accordingly, production rates of underground hydrocarbons can be increased if the viscosity can be reduced. This is particularly true for heavy hydrocarbons or hydrocarbons having high viscosity which are immobile and not recoverable when employing conventional recovery processes. Increased recovery rates have been successfully illustrated by many steam flooding processes in which the viscosity of underground hydrocarbons has been substantially reduced by heating the oil to higher temperatures by injection of steam into the reservoir. The method of the present invention, like that of the above Terwilliger patent, utilizes the technique of reduction of viscosity by temperature increase and also reduces the viscosity still further by dissolving and diluting the underground hydrocarbons with a low viscosity solvent.

Beyond this, however, the method of the present invention has several advantages over Terwilliger and other prior art solvent processes. These advantages include (1) substantially less heat and fuel requirements, (2) several fold reduction of the rate of solvent circulation, (3) attainment of higher displacement and recovery efficiencies of the heavy hydrocarbon (approaching 100%), (4) negligible solvent losses, and (5) a wider range of application of the process, including shallow depths. These advantages will be discussed in further detail.

It is one advantage of, and one essential feature of the present disclosure that the solvent is introduced into the reservoir as a vapor mixed with steam and that the solvent vapors comprise only a low percentage of the total vapor mixture. The steam/solvent vapor mixture is injected into a zone at the top of the reservoir. Since the vapor is undersaturated in solvent, only the steam condenses first and the steam provides almost all the heat required for reservoir heating. The solvent vapors pass almost completely through the hot vapor zone before condensing at the horizontal interface between the vapor and heavy hydrocarbon zones. Upon condensing, the solvent mixes with, dissolves, and dilutes the heavy hydrocarbons to reduce their viscosities to still lower values than could have been attained with heat alone. This low-viscosity solution of solvent and heavy hydrocarbons then flows downward under the force of gravity into the producing wells. Another essential feature of the present invention is that the producing wells must be open to the reservoir at some depth below the vapor zone—preferably at the bottom of the reservoir. The solvent/heavy hydrocarbon mixture is then recovered by being pumped (or more rarely, flowed) to the surface.

It is another essential feature, and an important advantage of the present invention that the pressure differential through the reservoir from injection to producing wells be controlled to very low values so that fluid flows occur almost entirely under the force of gravity alone. This results in a gravity stabilized displacement from the top of the reservoir downward. The pressure differentials are controlled to the desired low values by imposing back pressures as required against the producing wells.

Typically, prior art steam-solvent processes employ comparatively high pressure differentials from the point of injection to the point of production in the underground formation in order to increase the rate of flow of underground hydrocarbons toward the producing well. It has been well established, however, both in the laboratory and through field tests, that forced injection of low viscosity hydrocarbons into formations containing high viscosity hydrocarbons results in the formation of fingers of the low viscosity solvent breaking through at the production well. If the process is continued, a substantial portion of the injection solvent travels along these fingers or paths leaving much of the heavy hydrocarbon deposits uncontacted. Thus, while some of the objectives of a high pressure differential process may be accomplished, i.e., high production rates and high percentage recovery from the solvent swept zones, only a small portion of the hydrocarbons in the formation are affected before the process is rendered uneconomic because of the solvent bypassing effect.

The method of the present invention overcomes the disadvantages of a high pressure differential process by utilizing the force of gravity to stabilize the displacement of the heavy hydrocarbons by the steam and solvent vapor mixture. The pressure gradient across the viscous hydrocarbon deposit over most of the formation is limited to that furnished by the force of gravity. By minimizing the pressure gradient to the force of the gravity head, there is little tendency to force the light hydrocarbons through the heavy hydrocarbons and thus form low viscosity finger paths which break through at the production well.

In addition, the method of the present disclosure increases sweep efficiency by injecting hot fluids, such as steam or a steam-solvent vapor mixture, at the top of the formation and recovering heavy hydrocarbons and condensed fluids at the bottom of the formation at an adjacent production well. Since the injected fluids are hot gases, they are much lighter than the heavy hydrocarbons in the formation and therefore extend or spread across the top of the formation. The injected hot fluids remain above the underlying liquid zone until the hot gases give up their latent heat and condense to liquid and dissolve in the top layer of the underlying heavy hydrocarbons. This results in an almost horizontal solvent-steam vapor layer above the heavy hydrocarbons. The solvent-steam layer gradually moves downward as the heat of condensing steam and dilution effect of the solvent both act to reduce the viscosity of the heavy hydrocarbons to permit them to flow by gravity down to the production well. Any tendencies of the light solvent liquids to form fingers down through the colder viscous hydrocarbons, such as might be caused by local permeability variations within the formation, are counteracted by the greater hydrostatic head of the heavy hydrocarbons in the formation tending to force the lighter fluids back up to the top. The cold underlying reservoir of viscous hydrocarbons is much like an insulative barrier for the lighter fluids. Condensation of the injected solvent-steam fluids takes place along the contact area between the lighter fluids and the viscous hydrocarbons, thereby raising the temperature of the heavy hydrocarbons and increasing the mobility of the hydrocarbons. In this manner, a very stable displacement from the top to the bottom of the formation is established.

One disadvantage associated with the Terwilliger process, which uses pure solvent vapors, is that a large quantity of solvent is required to be injected into the formation. The method of the present invention, however, uses steam and solvent and adjusts the solvent to steam vapor ratio in the injected mixture so that the resulting vapor mixture is undersaturated in solvent. It is well known that at any given pressure and under such undersaturation conditions, the steam will condense first as the steam-solvent mixture gives up heat to the formation. No solvent will condense until after sufficient steam has been condensed to reduce the steam concentration to that value required for saturation at a given pressure and temperature. The steam and solvent vapors are then in equilibrium, and thereafter will both condense together.

Undersaturation of the injected mixture in solvent vapors produces several very favorable effects; first, the solvent vapors pass almost completely through the vapor zone spreading across the top of the formation before equilibrium is reached, thereby condensing at the boundary of the vapor and heavy hydrocarbon zones. Thus, use of an injected vapor mixture undersaturated with solvent vapor greatly reduces the total amount of solvent required for the disclosed recovery process without reducing the ability of the process to provide high solvent concentration in the region where it is required to contact the heavy hydrocarbons and go into solution with the hydrocarbons and thereby reduce the hydrocarbon viscosity.

Second, less heat is ultimately required with a process using a vapor mixture undersaturated in solvent. It is well known that the heat carrying capacity of hydrocarbon solvent vapors is only about one-fourth that of steam. Thus, to heat a reservoir to the same temperature, four times as much solvent must be circulated as would be needed if the heating were to be done by steam alone. The present process, in which most of the heat is provided by steam, greatly reduces the volume of hydrocarbon vapors which must be circulated, but even more importantly, it reduces the total heat requirements.

Because of the low latent heat of the solvent, it is necessary, as noted in the Terwilliger patent, that when pure solvent vapors are used, the injected vapors must be superheated in order that the hot vapor zone be maintained completely across the reservoir. The inevitable effect is that the reservoir itself is raised to a much higher temperature at the injection end than is needed to secure satisfactory producing rates. Thus, a steep temperature gradient is created across the reservoir in which the average reservoir temperature is much higher than that required with the present process which uses steam for the principal heat carrying medium and in which there is only a slight temperature gradient across the reservoir. Since the reservoir is raised to a lower average temperature in the present process, much less heat is required. As is well known, the principal expense in thermal recovery processes is the cost of the fuel which ultimately provides the reservoir heat. By reducing the heat requirements, the recovery method of the invention provides an improvement in the economics of the process.

Another advantage of injecting a steam-solvent vapor mixture undersaturated with solvent is that it provides a very high recovery efficiency from the swept zone (theoretically 100%). Once the solvent goes into solution with the heavy hydrocarbons, the solvent-heavy hydrocarbon mixture flows out of the reservoir pore spaces and down to the producing well. As is typical of all oil producing operations, both conventional and thermal recovery processes, not all of the liquid hydrocarbons can drain out of the reservoir rock. Some hydrocarbons are always trapped by the small throats in the pore spaces of the formation and cannot be recovered as a liquid. Both laboratory experiments and field tests indicate that in successful steam flood operations, the trapped unrecoverable oil, termed the irreducible saturation, generally amounts to the order of 10% to 30% of the reservoir pore space. In the method of the present disclosure, however, the heavy hydrocarbons are gradually replaced by the condensed steam-solvent liquid. The solvent concentration in the formation steadily increases with time. Thus, the final liquid trapped in the pore spaces will be essentially 100% solvent, all the oil having previously been displaced and produced.

Yet another advantage of using a vapor mixture undersaturated with solvent is that solvent losses are negligible. Unlike heavy oil, the solvent is easily distillable. As the process of the present disclosure proceeds and the horizontal condensation front drops lower into the formation, the liquid solvent trapped in the pore spaces (as described above) will be contacted by the incoming vapors of the steam-solvent mixture which is undersaturated in solvent vapor. The lean mixture vapor will rapidly reevaporate the liquid solvent trapped in the pore spaces and carry it along to the new condensation front, thereby leaving essentially no hydrocarbons or solvent in the pore spaces of the reservoir above the condensation front. At the economic end of the present process, solvent injection may be discontinued and steam alone injected into the reservoir for a few months to ensure that any solvent which was trapped in pore spaces of the reservoir is re-evaporated and recovered. This redistillation effect of the disclosed process greatly increases the ultimate heavy hydrocarbon recovery from the swept vapor zone above that which could have been obtained with steam flooding alone. It also recovers, in a continual process, the condensed solvent which would be left behind in the reservoir pore space if a pure solvent vapor or solvent liquid process were to be used.

In the Terwilliger patent, for example, it is necessary that a water drive or inert gas drive be conducted to recover the condensed solvent after all the heavy hydrocarbon has been produced. But as is well known both from laboratory experiments and field tests, these processes cannot recover all the liquid hydrocarbons trapped in the pore spaces and volumes amounting to about 10% of the pore space may be permanently lost. In the present process, however, the condensed solvent is recovered by distillation which is carried to 100% solvent recovery.

The method of the present disclosure can be operated at lower pressures and temperatures than can a steam flood which produces viscosity reduction by heat alone. By operating at lower pressures, the method can secure economic recovery from deposits which lie too close to the surface to contain the pressures required by a conventional steam flood.

The choice of solvent to be used with this method is not critical. Any light, readily distillable liquid that is miscible with the heavy hydrocarbons, will be satisfactory. Suitable solvents include, but are not limited to, gasolines, kerosene, naphthas, gas well condensates, natural gas plant liquids, intermediate refinery streams, benzene, toluene, and various distillates and cracked products.

Neither is the exact concentration of solvent critical. It may vary over a wide range from 3% solvent (by liquid volume) to as high as 65%. The method can be applied over a wide range of pressures and temperature. The operating pressure and temperature for a particular application is selected to meet the particular conditions of the reservoir to which the method is applied. The method may be operated at pressures slightly below atmospheric to as high as 1500 psi and at temperatures from 175° F. to as high as 550° F.

SUMMARY OF THE INVENTION

The process of the present invention relates to a gravity stabilized process for recovery of viscous hydrocarbons by reducing the viscosity of the hydrocarbons by introducing steam and a steam-solvent vapor mixture into the hydrocarbon bearing information. The steam-solvent vapor mixture is injected at the top of the information and produced liquids flow downward by gravity to be recovered at the bottom of the formation through an adjacent production well. The pressure at the producing well is controlled so that the pressure differential across the heavy hydrocarbons is approximately equal to the gravity head of the liquids in the formation. The steam-solvent vapor mixture is undersaturated in solvent permitting steam initially to condense and increase the temperature of the hydrocarbon formation, and subsequently the solvent condenses and goes into solution with the hydrocarbons, thereby further reducing the viscosity of the hydrocarbons beyond that reduction secured by heat alone. Continued introduction of steam-solvent vapor mixture replaces substantially 100% of the hydrocarbons from the swept zone. The process of the present disclosure may be performed at relatively low temperature and pressure and yet yields higher production rates of viscous hydrocarbons than other methods.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are, therefore, not to be considered limiting of its scope, for the invention may admit to other equally effective embodiments.

DETAILED DESCRIPTION OF THE PREFERRED EMBODIMENT

Figure 1:
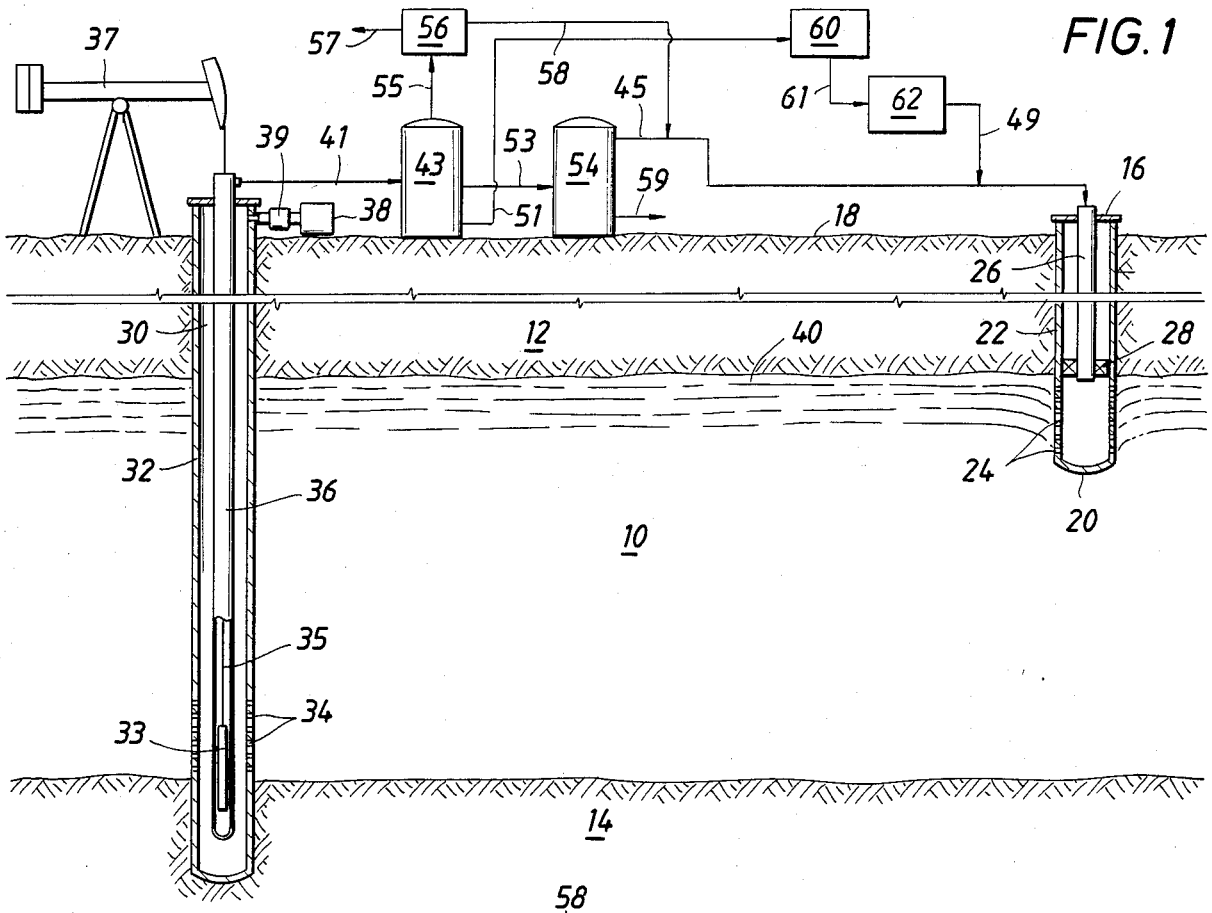
FIGS. 1–3 illustrate a subterranean formation having an injection well and a production well extending therein in which a steam-solvent vapor mixture is injected into the upper portion of the formation and hydrocarbons are produced from the lower portion of the formation through the production well, illustrating how the injected steam-solvent mixture migrates across the formation between the injection well and the production well and how oil is produced assisted by the force of gravity.
Figure 2:
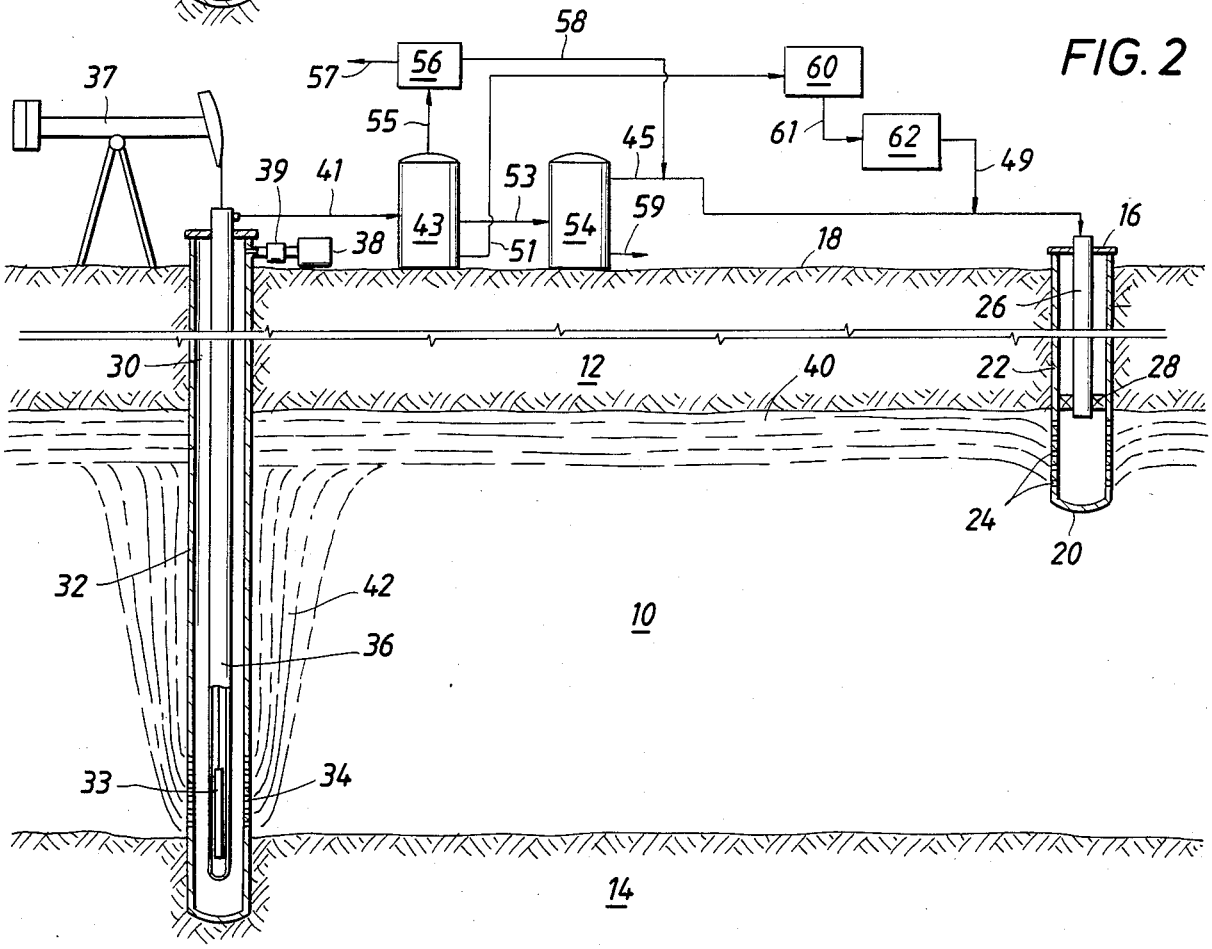
Figure 3:
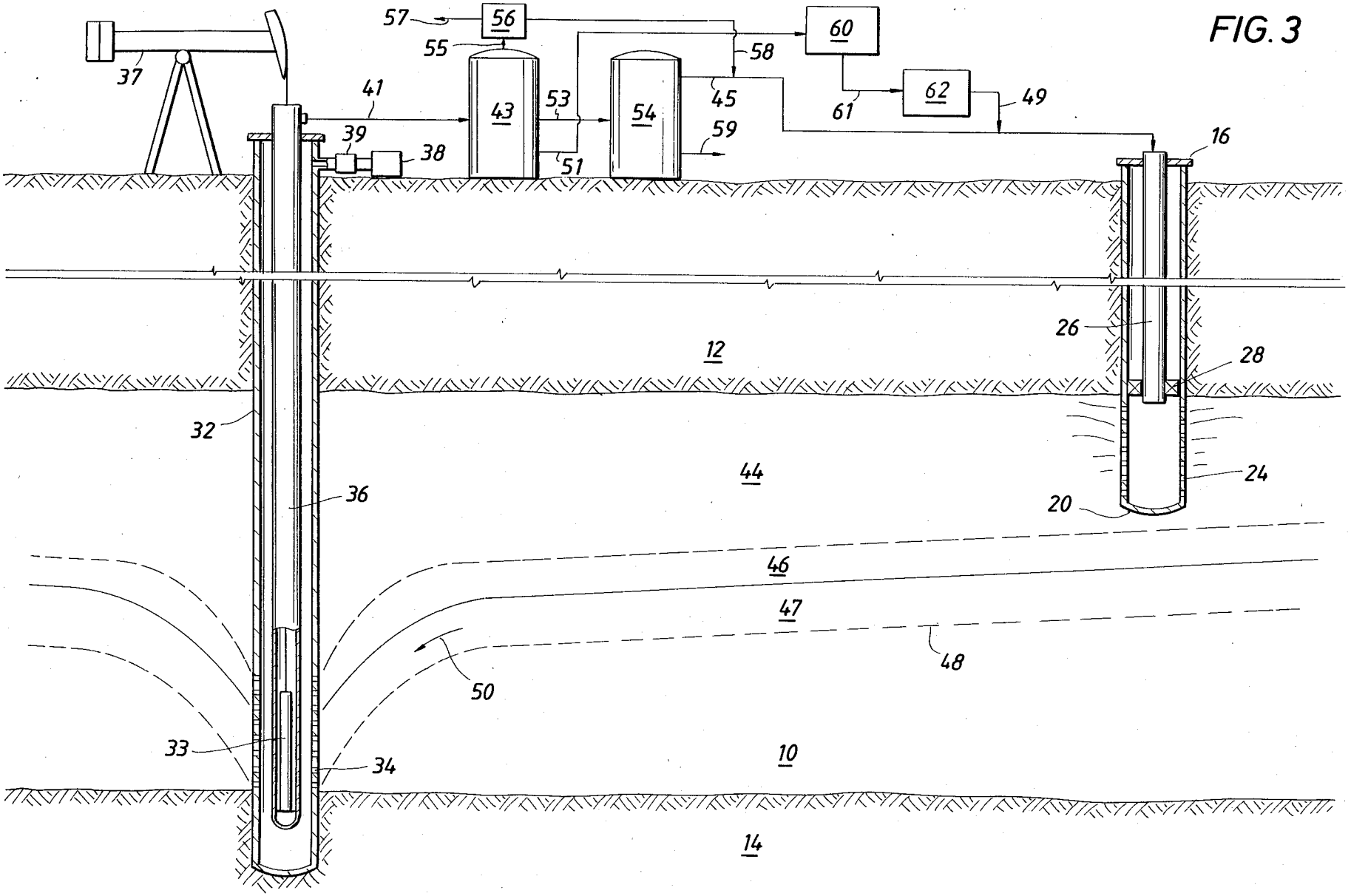

To illustrate the method of the invention, attention is directed to FIGS. 1–3 of the drawings wherein a hydrocarbon formation 10 is shown. The hydrocarbon formation 10 lies between an overburden 12 and an underlying formation 14. An injection well 16 extends from the surface 18 and is completed or terminates in the hydrocarbon formation 10 at 20. Injection well 16 is formed in a conventional manner comprising a casing 22 which extends into the hydrocarbon formation 10. Casing 22 is cemented in place in a conventional and well-known manner. Perforations 24 are formed through the casing 22 by any suitable manner. The perforations 24 are formed in the top portion of the hydrocarbon formation 10. A tubing 26 extends into the casing 22 through a packer 28 which is set within the casing 22 above the perforations 24. The top of the casing 22 is closed by any suitable means.

The perforations 24 are formed in the casing 22 in the top of the formation 10, therefore completion of the injection well 16 to the underlying formation 14 is not required for the process of the invention. The injection well 16 may be completed at any depth in the formation 10 below the upper portion thereof. If the injection well 16 is a preexisting well, then the lower portion of the well may be closed below the perforations 24 by setting a packer so that steam and solvent are not wasted filling the injection well 16 to the underlying formation 14.

A production well 30 is spaced from the injection well 16 a suitable distance depending on the flow characteristics of the hydrocarbon formation and the well pattern established for the hydrocarbon bearing reservoir. Typical distances between injection well 16 and production well 30 range from approximately 140 feet to 600 feet providing 1 to 10 acre spacing between the wells. Production well 30 comprises a casing 32 which extends into the underlying formation 14. Perforations 34 are formed in the lower portion of the casing 32 in the lower portion of the hydrocarbon formation 10. Tubing 36 extends into the casing with the bottom near or below the lower most perforations in the casing. A bottom hole pump 33 is run on sucker rods 35 inside the tubing 36 and is activated by a surface pumping unit 37 to lift produced fluids to the surface where they are piped to conventional production facilities. The upper end of the casing 32 is closed in a suitable manner and connected to surface piping through a pressure regulator or orifice control 38 in order to be able to control the process pressure and ensure against excessive venting of the steam and solvent vapors. In some applications, the casing may be completely shut in with a simple valve 39.

The numeral 41 identifies a flow line connecting the production well 30 to a heater treater 43 where gas is separated from the liquids and the liquids further separated into water and a hydrocarbon mixture of solvent and viscous hydrocarbons. The water is discharged through line 51 to a water treatment plant 60 where it is softened and delivered through line 61 to the steam generator 62. The gas from the heater treater 43 which contains a small percentage of solvent vapor is discharged through line 55 to a vapor recovery unit 56 where the solvent vapors are condensed to liquid and discharged through line 58 and thence through line 45 to be reinjected into well 16. The non-condensible gas is discharged through line 57 to be used as fuel for the steam generator or elsewhere on the lease.

The liquid solvent/viscous hydrocarbon mixture is discharged from the heater treater 43 through line 53 to the solvent recovery unit 54 where the solvent is then separated from the viscous hydrocarbon by distillation and then condensed back to a liquid. It is then injected back into well 16 via line 45.

Heavy hydrocarbons are discharged from the solvent recovery unit 54 through the line 59 for delivery to sales facilities.

The viscous hydrocarbon recovery process of the present disclosure is begun by establishing a blanket zone of heat across the top of the hydrocarbon formation 10 to form a hot zone 40, as shown in FIG. 1. This is accomplished by injecting steam into the injection well 16 which enters the hydrocarbon formation 10 through perforations 24 of the casing 22. Solvent may also be included with the steam but is not necessary during the start up phase of the process. As is apparent from FIG. 1, the hot zone 40 spreads radially from the injection well 16 across the top of the hydrocarbon formation 10.

A zone or path must also be established between the top of the hydrocarbon formation at the injection well 16 and the bottom of the hydrocarbon formation 10 at the production well 30. This is accomplished by injecting steam or a steam-solvent mixture through the tubing 36 and into the hydrocarbon formation 10 through the perforations 34. As has been generally observed in steam flood projects, steam has a tendency to rise to the top of the hydrocarbon formation 10 as shown in FIG. 2. The steam gradually rises to the top of the hydrocarbon formation in a substantially vertical path 42 to intercept the hot zone 40. Once the heat path 42 reaches the hot zone 40, communication between the injection well 16 and the production well 30 is established.

Steam may be introduced into the hydrocarbon formation through the production well 30 intermittently or continuously until heat communication between the injection well 16 and the production well 30 is established. If periodic injections are used, the production well 30 may be returned to production between injection periods while heat communication between the hot zone 40 and production well 30 is being established. Depending on the size of the initial injection, it may be necessary to repeat injections of steam through the production well 30 over a period of several months before the heat path 42 is established.

The heat zone 40 and heat path 42 may be formed alternately or simultaneously. Simultaneous injection of steam through the injection well 16 and the production well 30 will establish a hot communication zone between the injection well 16 and production well 30 much faster than if steam is introduced into the formation 10 alternately through either of the wells 16 and 30.

Once a hot communication path has been established between the injection well 16 and the production well 30, the hot liquid hydrocarbons at the top of the hydrocarbon formation are free to drain down under the force of gravity to the perforations 34 of the production well 30. The draining oil or hydrocarbons collect in the bottom of the casing 32 and are lifted or flowed to the surface in a conventional manner. Suitable back pressure is maintained against the producing well to ensure that pressure differentials in the reservoir do not greatly exceed the force of gravity. A continuous producing steam-solvent flood is now established by continuous injection through the injection well 16 of a steam-solvent mixture to maintain the hydrocarbon formation temperature and pressure. Injection of the steam/lean solvent vapor mixture is continued until substantially all of the hydrocarbons in the formation 10 are drained and recovered through the production well 30.

To illustrate the benefits of the method described herein, after the hot communication zone is established between the injection well 16 and the production well 30, the following presents the results of example calculations which illustrate the beneficial effects of injection of small amounts of a volatile solvent into the reservoir along with the steam.

It should be understood that while the description of the operation is in accord with the preferred embodiment, the particular values of pressure, temperature, and solvent concentrations for this calculation were chosen for illustration only and are not an essential part of the preferred embodiment. As previously noted, the present method can operate satisfactorily over a wide range for these values. Similarly, for purposes of this illustration, it is assumed that the solvent has the properties of toluene. It is understood, however, that other solvents which are soluble in hydrocarbons may also be used. The solvents may be injected as either a hot vapor or as a cool liquid. In the latter case, it will be instantly turned into a hot vapor as soon as it comes into contact with the hot steam. Typically, a line carrying 500 barrels (cold water equivalent) per day of steam at 100 psia and 75% quality is connected to the injection well 16. Assuming for this example that 87 barrels per day of liquid solvent at 60° F. are injected into the steam stream, the steam quality will be reduced by 4.4% and give up enough heat to flash all the solvent to a vapor. Thus, the steam-solvent vapor mixture entering the formation 10 through the perforations 24 is a vapor mixture comprised of steam and solvent.

Proceeding then, and allowing for a 50 psi pressure drop and another 5% reduction in steam quality in the tubing 36 injection well 16, it may be calculated that the vapor mixture entering the formation 10 at 50 psia will contain 4.3% by volume toluene vapor and 95.7% by volume steam vapor. This vapor mixture is undersaturated in toluene, that is, it contains a far lower percentage of toluene than the 39.4% which would be required for the toluene to be in equilibrium with steam at 50 psia. Consequently, only the steam condenses initially as the vapor mixture travels radially away from the injection well 16 through the hydrocarbon formation 10. Steam condensation provides substantially all the heat needed to raise the temperature of the contacted area of the formation 10 to approximately 280° F. and to provide for conductive losses above and below the horizontal steam or hot zone 44 shown in FIG. 4. No solvent will condense until after sufficient steam has condensed to reduce the steam concentration to that value required for saturation at a given pressure and temperature. It may be calculated from the Law of Partial Pressures that the toluene vapor condenses to liquid only after approximately 477 barrels of the 500 barrels of steam originally injected into the hydrocarbon formation 10 have condensed to water. At this point, equilibrium vapor saturation has been reached, i.e., 39.4% by volume toluene and 60.6% by volume steam. Thereafter, the steam and toluene will condense together in a ratio of 3.8 barrels of toluene per barrel of water, assuming the liquids are referenced at 60° F.

The above calculation assumes steam and toluene condense in the absence of viscous hydrocarbons. When condensing in contact with viscous hydrocarbons, the toluene will condense much more readily than the steam, which selective condensation is desired and one of the benefits of the process of the present disclosure. This effect, although not considered in this simplified example, may be calculated for any reservoir conditions using basic vapor pressure principles.

Referring now to FIG. 3 and considering the process thus far described, the lean vapor mixture has carried the toluene vapor across the solvent lean vapor zone 44. In the zone 44, only steam condenses. As the steam condenses, a solvent-rich vapor zone 46 is established which extends across the reservoir immediately below the vapor zone 44. As the toluene condenses and contacts the viscous hydrocarbons, a mixing zone 47 of solvent and heavy hydrocarbons is established, thereby reducing the viscosity of the hydrocarbons. The heat of condensation of the solvent is additive to the heat given up by the condensing steam, and this helps heat the next layer or zone of hydrocarbons 10. The line 48 in FIG. 3 defines the boundary between the mixing zone 47 and the underlying layer of heavy hydrocarbons in the formation 10. In the mixing zone 47, the solvent goes into solution with the hydrocarbons resulting in a mixture of solvent and hydrocarbons of reduced viscosity which flows under the force of gravity, as indicated by the arrows 50, toward the production well 30.

By trial-and-error type calculation, it may be found that the process described herein will be in equilibrium when one part solvent has gone into solution with two parts of the viscous hydrocarbons. At this concentration, the resulting liquid hydrocarbon solution would have a viscosity of 3.43 cp. Comparing this viscosity to the 90 cp viscosity of the undiluted viscous hydrocarbons at the same temperature, it is seen that the viscosity has been reduced by a factor of 90/3.43 or 26.2 times more than could have been achieved with steam alone. Accordingly, the flow rate of the solvent/hydrocarbon solution through the formation 10 will be 26.2 times as great. Therefore, the production rate will be 262 barrels of oil per day, assuming a rate of 10 barrels per day for the undiluted viscous hydrocarbons.

The 262 barrels of recovered solvent/hydrocarbon mixture contains 175 barrels per day of viscous hydrocarbons in addition to the 87 barrels per day of injected solvent. Thus, the addition of solvent has increased the rate of production of the viscous hydrocarbon by a factor of 175/10 or 17.5 times the assumed rate of 10 barrels per day with heat alone in a 50 psia steam flood.

In addition to increasing the production rate, use of the present method provides substantially better recovery efficiencies than can be attained by an unaided steam flood. Using as representative values for a typical steam flood an initial heavy hydrocarbon saturation ($S_{oi}$) of 75% and a final saturation ($S_{or}$) of 20%, it is seen that the recovery efficiency is:

(Soi-Sor)/Soi (100) which yields (0.75−0.20)/0.75 (100) or 73.3%

With the addition of solvent according to the process described herein resulting in a final saturation ($S_{or}$) of zero, a recovery efficiency of 100% calculated as follows can be approached:

$$(0.75-0)100/0.75=100\%$$

The improvement in recovery is 36% calculated as follows:

$$100\%-73.3\%/73.3\%\ (100)=36\%$$

The above examples are merely illustrative of the process of the present invention. While the foregoing is directed to the preferred embodiments of the present invention, other and further embodiments of the invention may be devised without departing from the basic scope thereof, and the scope thereof is determined by the claims which follow.

What is claimed is:

1. A method of recovering hydrocarbons from a subterranean reservoir containing high viscosity hydrocarbons, the method comprising the steps of:

(a) forming an injection well in fluid communication with an upper portion of the reservoir;

(b) forming a production well in fluid communication with a bottom portion of the reservoir and extending to a depth in the reservoir below the injection well;

(c) injecting steam into the upper portion of the reservoir through the injection well to form a vapor zone in the upper portion of the reservoir;

(d) establishing a heated path between the injection well and the bottom portion of the reservoir at the production well;

(e) injecting a solvent as a vapor into the reservoir capable of dissolving the hydrocarbons, the injection of solvent vapor occurring along with the steam injection forming a steam-solvent vapor mixture undersaturated in solvent and saturated with steam, wherein the steam and solvent condense and release heat to the reservoir, the condensed solvent mixing with the hydrocarbons and forming a solvent-hydrocarbon mixture having a viscosity lower than the reservoir hydrocarbon viscosity;

(f) establishing a flow path for the solvent-hydrocarbon mixture from a region of solvent and steam condensation in the upper portion of the reservoir downwardly toward the bottom of the production well, the flow of the solvent-hydrocarbon mixture occurring substantially entirely under the force of gravity; and (g) collecting the solvent-hydrocarbon mixture from the production well.

2. The method of claim 1 wherein the step of establishing a heated path between the injection well and the productive well includes the step of injecting steam into the lower portion of the reservoir through the production well to establish a substantially vertical flow path extending upwardly from the lower portion of the reservoir in fluid communication with the vapor zone formed in the upper portion of the reservoir.

3. The method of claim 1 wherein the step of establishing a heated path between the injection well and the production well includes the step of simultaneously injecting steam through the injection and production wells.

4. The method of claim 1 wherein said solvent is injected at the injection well in liquid form and is vaporized upon contact with the steam.

5. The method of claim 1 wherein the steam and solvent injected in the reservoir define an injection stream which is undersaturated with solvent and saturated with steam.

6. The method of claim 5 wherein said steam condenses first as said steam and solvent travel across the vapor zone raising the temperature of the vapor zone and said solvent condenses upon reaching an equilibrium condition between said steam and solvent.

7. The method of claim 1 including the step of controlling pressure differentials through the reservoir so that flow of the solvent-hydrocarbon mixture occurs substantially entirely under the force of gravity.

8. The method of claim 1 including the step of continuing injection of solvent and steam until substantially all of the hydrocarbons in the reservoir have been recovered.

9. The method of claim 8 including the step of terminating the injection of solvent near the end of the recovery process and continuing the injection of steam to reevaporate and recover condensed solvent remaining in the reservoir.

10. A method of recovering viscous hydrocarbons from a subterranean reservoir, said reservoir being penetrated by at least one injection well and one production well, said injection well being in fluid communication with the upper portion of the reservoir and said production well being in fluid communication with the lower portion of the reservoir, said injection well and said production well defining a fluid flow path therebetween, the method comprising the steps of:

(a) injecting a steam-solvent vapor mixture into the upper portion of the reservoir through the injection well, said steam-solvent vapor mixture being undersaturated in solvent and saturated with steam;

(b) reducing the viscosity of the hydrocarbons by heat released upon condensation of the steam-solvent vapor mixture and reducing the viscosity of the hydrocarbons further upon condensation of solvent vapors, the condensed solvent vapors going into solution with the hydrocarbons; and (c) collecting a mixture of hydrocarbons and solvent accumulated at the bottom of the production well substantially entirely under the force of gravity.

11. The method of claim 10 wherein steam condenses first as said steam-solvent mixture travels across the reservoir raising the temperature of the reservoir and solvent condenses upon reaching an equilibrium condition between said steam and said solvent.

12. The method of claim 10 wherein the fluid flow path is established by injecting steam into the lower portion of the formation through the production well establishing a substantially vertical flow path extending upwardly from the lower portion of the reservoir in fluid communication with a vapor zone formed in the upper portion of the reservoir by injecting steam through the injection well in the upper portion of the reservoir.

13. The method of claim 12 including the step of simultaneously injecting steam through the injection and production wells to establish the fluid flow path.

14. The method of claim 10 wherein solvent is injected at the injection well in liquid form and is vaporized upon contact with the injected steam to form said steam-solvent vapor mixture.

15. The method of claim 10 including the step of controlling pressure differentials through the reservoir so that flow of the solvent-hydrocarbon mixture occurs substantially entirely under the force of gravity.

16. The method of claim 10 including the step of continuing injection of said steam-solvent vapor mixture until substantially all of the hydrocarbons in the reservoir have been recovered.

17. The method of claim 16 including the step of terminating the injection of solvent near the end of the recovery process and continuing the injection of steam to reevaporate and recover condensed solvent remaining in the reservoir.

18. A method of recovering viscous hydrocarbons from a subterranean reservoir, said reservoir being penetrated by at least one injection well and one production well, said injection well being in fluid communication with the upper portion of the reservoir and said production well being in fluid communication with the lower portion of the reservoir, the method comprising the steps of:

(a) injecting steam into the upper portion of the reservoir through the injection well to form a vapor zone in the upper portion of the reservoir;

(b) establishing a heated fluid flow path between said vapor zone and the bottom portion of the reservoir at the production well;

(c) injecting a steam-solvent vapor mixture into said vapor zone in the upper portion of the reservoir through the injection well, said steam-solvent vapor mixture being undersaturated in solvent and saturated with steam;

(d) controlling pressure differentials through the reservoir so that flow of hydrocarbons occurs substantially entirely under the force of gravity; and (e) collecting a mixture of hydrocarbons and solvent accumulated at the bottom of the production well.

19. The method of claim 18 wherein steam condenses first as said steam-solvent mixture travels across the reservoir raising the temperature of the reservoir and solvent condenses upon reaching an equilibrium condition between said steam and said solvent.

20. The method of claim 18 wherein the heated fluid flow path is established by injecting steam into the lower portion of the formation through the production well thereby establishing a substantially vertical flow path extending upwardly from the lower portion of the reservoir in fluid communication with said vapor zone formed in the upper portion of the reservoir.

21. The method of claim 20 including the step of simultaneously injecting steam through the injection and production wells to establish the heated fluid flow path.

22. The method of claim 18 wherein solvent is injected at the injection well in liquid form and is vaporized upon contact with the injected steam to form said steam-solvent vapor mixture.

23. The method of claim 18 including the step of continuing injection of said steam-solvent vapor mixture until substantially all of the hydrocarbons in the reservoir have been recovered.

24. The method of claim 23 including the step of terminating the injection of solvent at the end of the recovery process and continuing the injection of steam to reevaporate and recover condensed solvent remaining in the reservoir.

* * * * *